United States Patent [19]

Goldberg

[11] Patent Number: 4,744,228

[45] Date of Patent: May 17, 1988

[54] AGITATORLESS CLOTHES LAUNDERING

[76] Inventor: Michael Goldberg, 118 Page Rd., Bedford, Mass. 01730

[21] Appl. No.: 789,635

[22] Filed: Oct. 21, 1985

[51] Int. Cl.[4] ..... D06F 17/04

[52] U.S. Cl. ..... 68/20; 68/184

[58] Field of Search ..... 68/19.2, 20, 23 R, 26, 68/184, 207, 10; 366/137; 134/186

[56] References Cited

U.S. PATENT DOCUMENTS

| | | | |
|---|---|---|---|
| 2,278,911 | 4/1942 | Breckenridge | 68/184 X |
| 3,145,551 | 8/1964 | Ziegler | 68/10 X |
| 3,333,443 | 8/1967 | Chung et al. | 68/23 R |
| 3,413,827 | 12/1968 | Kochanek | 68/184 X |

FOREIGN PATENT DOCUMENTS

| | | | |
|---|---|---|---|
| 1142557 | 4/1957 | France | 366/137 |
| 821582 | 10/1959 | United Kingdom | 68/184 |

*Primary Examiner*—Philip R. Coe

*Attorney, Agent, or Firm*—Charles Hieken

[57] ABSTRACT

A washing machine has a stationary tub with drain outlets at the bottom periphery. A venturi conduit extends from the bottom of the tub opening upward along the axis of the tub to produce a toroidal flow of water in an open basket in the tub seated on an annular disk surrounding the venturi opening. The annular disk is mounted on rollers at the bottom of the tub and carries permanent magnets. An annular driving member also carrying magnets is located below the bottom of the tub surrounding the conduit connected to the venturi and carries permanent magnets opposite those on the annular disk inside the tub. A pulley at the bottom of the driving member is coupled by a belt to the pulley on a drive motor. A pump is connected between the venturi and the tub outlets. A selectively operable valve controls the flow of water between the venturi and a drain outlet. This assembly is contained in a cabinet having an opening covered by a lid. The opening is large enough to allow removal and insertion of the open basket. A companion dryer has a rearward tilted drum that receives the open basket with the laundered clothes. Alternatively, the dryer may have a lid that opens from the top with the basket inserted between stationary guides to rest on a carriage of rollers in the mid portion of the dryer cabinet. A drive motor drives the roller carriage which rotates the basket. When the lid is closed, a conduit is defined which passes drying air through the basket as it rotates.

7 Claims, 4 Drawing Sheets

AGITATORLESS CLOTHES LAUNDERING

This invention relates in general to clothes laundering and more particularly concerns a novel clothes washer in which agitation is achieved by means of pump circulation of the wash water in a toroidal pattern, and a companion clothes dryer, perferably of the heat pump type disclosed in copending U.S. application Ser. No. 06/657,896, and now U.S. Pat. No. 4,603,489, entitled HEAT PUMP CLOSED LOOP DRYING.

The invention provides agitation equivalent to a delicate cycle at all times, while providing cleaning action superior to the heavy duty cycle of conventional machines. There is no mechanical agitator required for this machine, providing room in the tub for more laundry. Such a machine will offer larger capacity, gentle fabric handling, and greatly reduced manufacturing cost.

According to the invention, a clothes washer includes pump means for circulating the wash water in a toroidal pattern, preferably through removable basket means for supporting the clothes, and preferably means for rotating the basket means at high speed after the water is drained for removing water from the washed clothes. Preferably, the basket means may be transferred with the washed clothes to the dryer which includes means for rotating the basket means while circulating air therethrough to remove moisture from the clothes.

Figure 1:
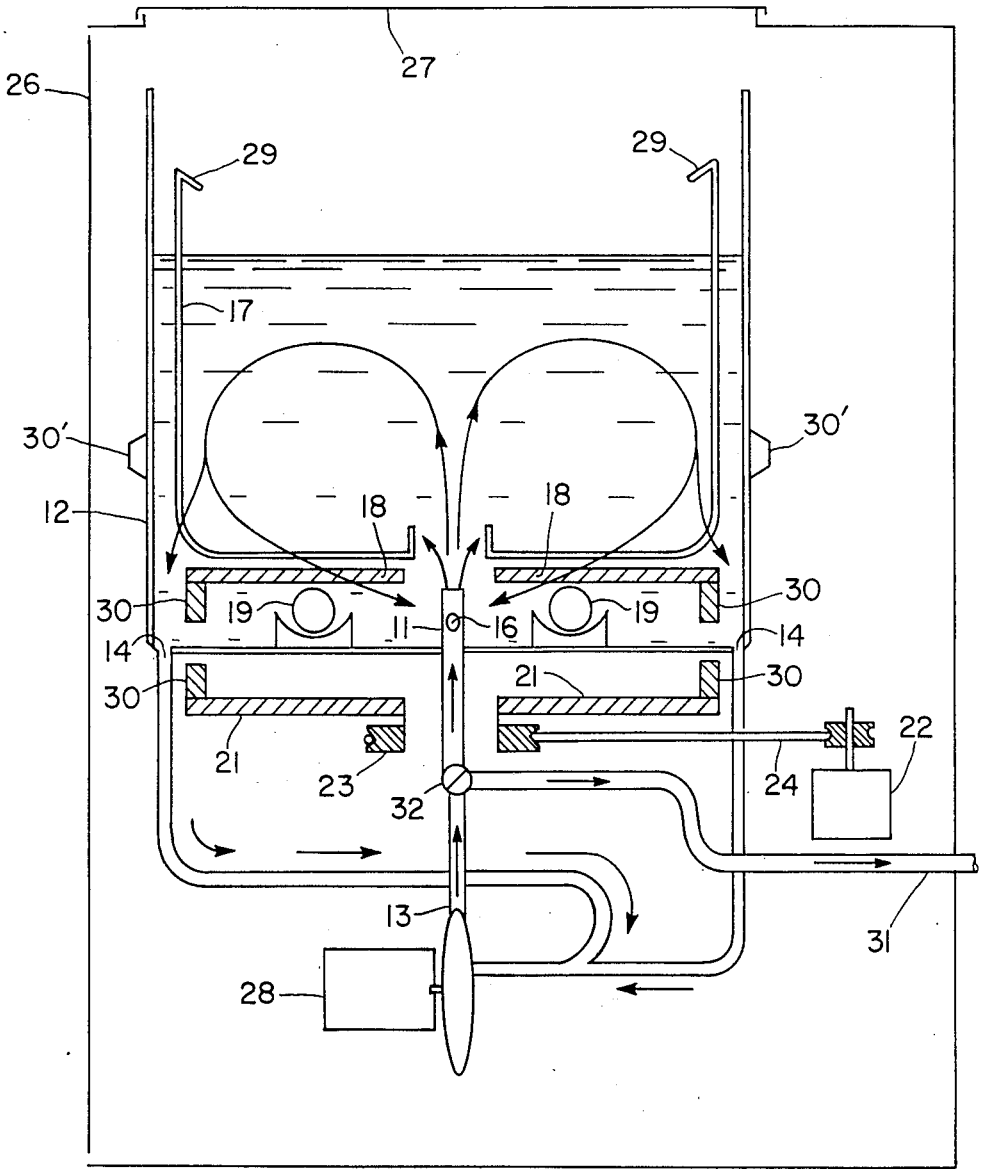
Figure 2A:
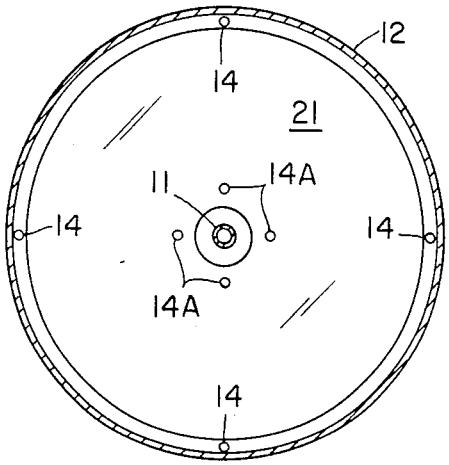
Figure 3:
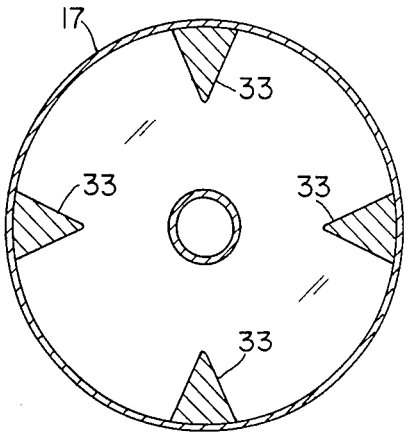
Figure 2B:
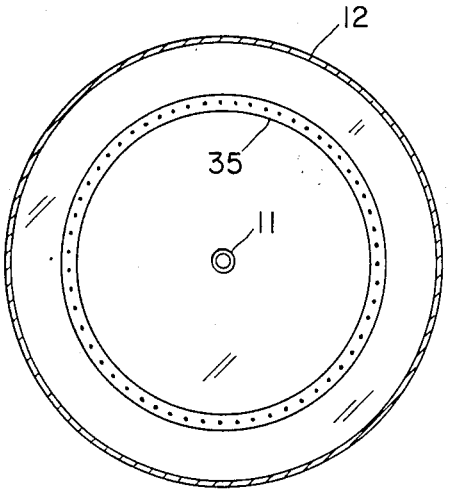
Figure 2C:
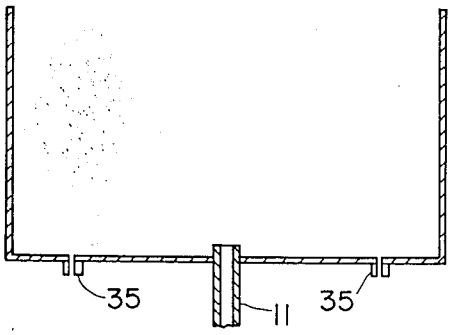
Figure 4:
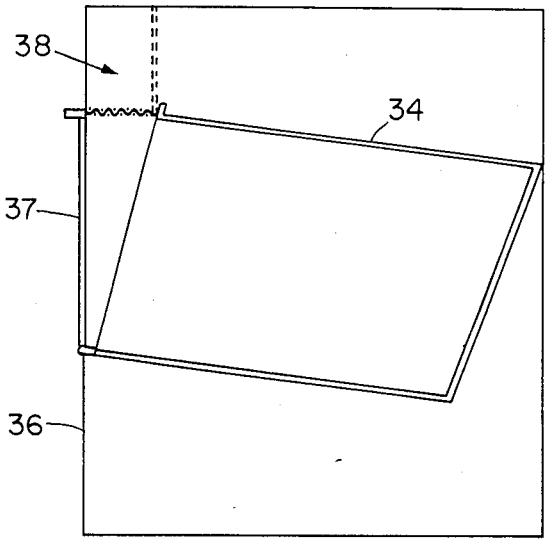
Figure 5:
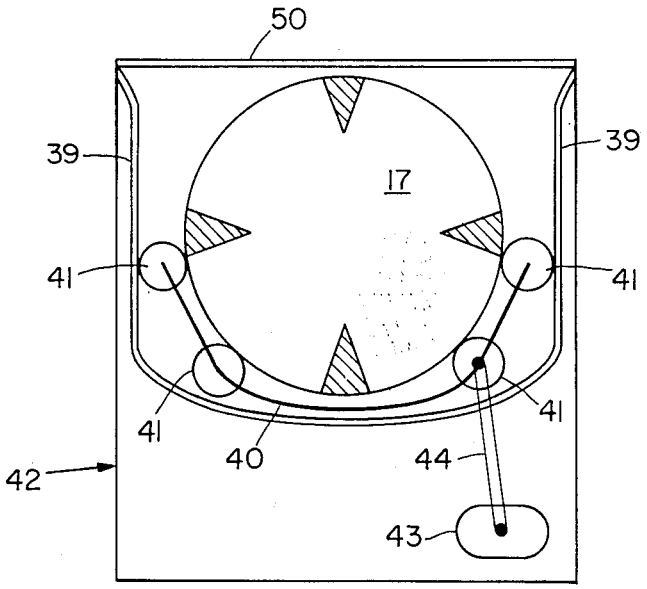

Numerous other features, objects and advantages of the invention will become apparent from the following specification when read in connection with the accompanying drawing in which:

FIG. 1 is a vertical sectional diagrammatic representation of an embodiment of a washer according to the invention;

FIG. 2*a* is a diagrammatic horizontal sectional view just above the tub bottom showing drain openings;

FIG. 2*b* is a similar view of an alternative construction with molded-in drain perforations;

FIG. 2*c* is a diagrammatic vertical sectional view of the molded-in drain perforations;

FIG. 3 is a diagrammatic transverse sectional view of a basket formed with vanes for assisting spin and tumbling action; and FIGS. 4 and 5 are diagrammatic vertical sectional views of companion dryers.

With reference now to the drawing and more particularly FIG. 1, there is shown a vertical sectional diagrammatic representation of a washer according to the invention with toroidal circulation achieved with a vertical upward pointing eductor 11, located centrally at the bottom of the wash tub 12, and connected to the discharge 13 of the circulator pump 28. A plurality of intakes 14 may be located at the bottom circumference of tub 12 as shown in FIG. 2*a*. Any reasonable number of intakes may be used, but they are preferably placed symmetrically around the circumference of tub 12. A minimum of three or four is preferred. Alternatively, an intake ring 35 with small perforations may be molded into the base tub 12 as shown in FIGS. 2*b* and 2*c*.

Eductor 11 draws water from vents 16 located symmetrically about its base. This causes the volume of water circulated in tub 12 to be substantially higher than that circulated through pump 28. The toroidal flow path is unbroken at the bottom of tub 12 where much of the water travels radially to the center from the circumference. Preferably, the flow rate and discharge pressure of the circular are selected to completely fluidize the clothing load so it does not rest on the bottom of tub 12 at all during the wash.

In an alternative configuration shown in FIG. 2*a*, eductor 11 may comprise a similarly located velocity increasing nozzle, and the intakes or intake ring relocated from the circumference of tub 12 to a small circle 14A immediately surrounding the base of the nozzle. This approach may require higher pump displacement at somewhat reduced discharge pressures, and may have practical advantages. It is also conceivable that circulation patterns other than the toroidal one may be more effective or at least acceptable.

Tub 12 is filled in the conventional manner via hose connections to the water supply, and standard solenoid valves. A lint filter may be employed at the circulator pump intake or any other appropriate location, and preferably mounted at a location convenient for cleaning.

If desired, the cleaning action may be enhanced by means of ultrasound of appropriate frequency or frequencies. Ultrasound transducers 30' may be located near the bottom of tub 12 or other desirable location. This may allow the use of cold water exclusively, and reduce the detergent required per load.

The spin cycle is provided by spinning inner basket 17. Basket 17 may include vanes 33, similar to vanes in a conventional dryer, as shown in FIG. 3, to assist the spin and tumbling actions. In spin mode, the circulator pump discharge is diverted to drain connection 31 by solenoid valve 32. In order to eliminate the need for a rotating seal at the bottom of the tub, and allow for piping to the eductor 11 or nozzle, a magnetic coupling to the basket may be used. This arrangement is ideal in the absence of an agitator, as the need for a high torque coupling is eliminated. Additionally, magnetic coupling offers a zero wear clutch action, which will soft load the drive motor on startup.

This magnetic coupling, as illustrated in FIG. 1, comprises a turntable 18 resting rotatably on ball bearings 19, and drive disk 21. Turntable 18 and drive disk 21 are rotationally coupled by magnets 30 which are arranged, in suitable number, symmetrically around the circumference of each. The basket rests removably on turntable 18, and may be coupled rotationally to turntable 18 by means of locating pins, molded bosses or the like. Drive disk 21 is coupled to spin motor 22 by belt 24 or other appropriate means. All components, except the magnets and pulley 23 are preferably of plastic, such as polypropylene or high density polyethelene, allowing free passage of magnetic flux, and providing absolute freedom from rust.

The motor in this system is required only to spin the clothes. This greatly simplifies the construction of the machine, eliminating completely the expensive transmission. The pump may be of the direct coupled type with its own motor. This eliminates the need for a spin clutch assembly, as the spin motor can be shut down during all cycles other than spin.

The basket is preferably of molded plastic, and removable. Lid 27 is hingedly attached to cabinet 26 and is large enough to clear the basket completely. The user may purchase as many baskets as desired, and load the washer by simply raising lid 27, removing the empty basket and inserting a full one.

Referring to FIGS. 4 and 5, there are shown similar diagrammatic representations of a companion clothes dryer for coacting with the washer of FIG. 1 so the basket of clean wet laundry may be removed from the washer, and inserted directly into the dryer. To facilitate this, the basket may employ a ring 29 around the top edge with an inside diameter a few inches smaller than that of the basket itself. This ring need not be perforated, and may be inclined inward like a funnel to facilitate loading the basket with laundry. This ring will serve to prevent the laundry from falling out when the basket is turned to face forward for insertion into the dryer.

The dryer may incorporate a rearward tilted drum 34 to facilitate inserting basket 17 as shown in FIG. 4. It need only be pitched about 30 degrees, and the face 36 and door 37 of the cabinet may remain vertical. This will allow space at the top of the door opening 38 for the air intake and lint filter which are often found at the bottom of the door opening in conventional dryers.

The dryer may also be configured for top loading as shown in FIG. 5. The lid 50 may open from the top as does the washer lid 27, and basket 17 may be inserted between stationary guides 39 to rest on a carriage 40 of rollers 41 in the mid portion of cabinet 42. There is no drum. The basket is rotated by the roller carriage which is coupled to the drive motor 43 with belt 44. When the lid 50 is closed, a conduit is defined which passes drying air through basket 17 as it rotates. This air may pass vertically or horizontally as desired.

There has been described novel apparatus and techniques for laundering characterized by effective cleaning and drying with relatively inexpensive equipment and reduced wear of the clothes being laundered while facilitating transfer to and from the laundry equipment. It is evident that those skilled in the art may now make numerous uses and modifications of and departures from the specific embodiments described herein without departing from the inventive concepts. Consequently, the invention is to be construed as embracing each and every novel feature and novel combination of features present in or possessed by the apparatus and techniques herein disclosed and limited solely by the spirit and scope of the appended claims.

What is claimed is:

1. Laundering apparatus comprising, tub means having an axis and a bottom for holding clothes in water, eductor means along the axis of said tub means for ejecting a stream of water to create a toroidal flow of water in said tub means and receiving water entering the eductor means at the tub means bottom, means for maintaining said tub means stationary and free of a mechanical member relatively displaced with respect to said tub means when said toroidal flow of water is produced, and open basket means seated in said tub means for containing clothes to be washed in said tub means in said toroidal flow of water.

2. Laundering apparatus in accordance with claim 1 wherein said eductor means comprises a venturi conduit at the bottom of said tub means directing said stream of water upward along the axis of said tub means, pump means for directing said water through said venturi conduit, said tub means having outlet means for draining water from said tub means, said pump means having inlet means coupled to said tub means outlet means for receiving water from said tub means for recirculation in said toroidal flow pattern.

3. Laundering apparatus in accordance with claim 2 and further comprising, annular disk means formed with an opening through which said venturi conduit passes rotatably supported inside and on the bottom of said tub means for supporting said basket means, rotatable drive means below said bottom for providing rotating energy to said annular disk means to cause said basket means to rotate about the axis of said tub means, and means for magnetically coupling said rotatable drive means to said annular disk means.

4. Laundering apparatus in accordance with claim 3 and further comprising, drain means for draining water from said tub means, and valve means for selectively opening said drain means and closing the flow to said venturi conduit to allow said pump means to drain water from said outlet means to said drain means.

5. Laundering apparatus in accordance with claim 2 and further comprising cabinet means having a top for enclosing at least said tub means, said basket means and said pump means, said cabinet means being formed with a coverable opening at the top thereof for allowing said basket means to be inserted into and removed from said tub means.

6. Laundering apparatus in accordance with claim 2 and further comprising, a dryer, said dryer having means for receiving said basket means with clothes therein and imparting rotating motion to said basket means while air flows therethrough for removing moisture from the clothes then in said basket means.

7. Laundering apparatus in accordance with claim 1 wherein said eductor means comprises a vertical tube surrounding said axis for ejecting said stream of water vertically upward along said axis.

* * * * *